US008647075B2

(12) United States Patent
Gulati

(10) Patent No.: US 8,647,075 B2
(45) Date of Patent: Feb. 11, 2014

(54) CONTROL VALVE FOR A VARIABLE DISPLACEMENT PUMP

(75) Inventor: Navneet Gulati, Eden Prairie, MN (US)

(73) Assignee: Eaton Corporation, Cleveland, OH (US)

( * ) Notice: Subject to any disclaimer, the term of this patent is extended or adjusted under 35 U.S.C. 154(b) by 786 days.

(21) Appl. No.: 12/406,813

(22) Filed: Mar. 18, 2009

(65) Prior Publication Data

US 2010/0236399 A1 Sep. 23, 2010

(51) Int. Cl.
*F04B 1/26* (2006.01)

(52) U.S. Cl.
USPC ..... 417/222.1; 417/269; 92/13; 137/625.67; 137/625.69

(58) Field of Classification Search
USPC ..... 417/222.1, 269, 53; 92/12.2, 13; 60/452; 137/596.1, 636.2, 625.69, 137/625.67, 107; 251/366, 63, 205
See application file for complete search history.

(56) References Cited

U.S. PATENT DOCUMENTS

| | | | | | |
|---|---|---|---|---|---|
| 3,064,676 | A | * | 11/1962 | Baker | 137/501 |
| 3,648,733 | A | * | 3/1972 | Hahn et al. | 137/625.69 |
| 3,720,221 | A | * | 3/1973 | Hufeld et al. | 137/112 |
| 3,726,093 | A | | 4/1973 | Malott | |
| 3,866,418 | A | | 2/1975 | Waters | |
| 3,866,419 | A | | 2/1975 | Paul | |
| 4,028,010 | A | | 6/1977 | Hopkins | |
| 4,149,830 | A | | 4/1979 | Woodruff | |
| 4,245,962 | A | | 1/1981 | Uehara et al. | |
| 4,285,639 | A | * | 8/1981 | Woodring et al. | 417/218 |
| 4,348,159 | A | | 9/1982 | Acheson | |
| 4,349,319 | A | | 9/1982 | Byers et al. | |
| 4,368,872 | A | * | 1/1983 | Machat | 251/63 |
| 4,416,189 | A | * | 11/1983 | Budzich | 91/421 |
| 4,476,680 | A | * | 10/1984 | Pollman et al. | 60/444 |
| 4,651,776 | A | * | 3/1987 | Nakano et al. | 137/625.69 |
| 4,668,171 | A | | 5/1987 | Beutler et al. | |
| 4,669,571 | A | | 6/1987 | Kurde | |
| 4,810,171 | A | | 3/1989 | Krebs | |

(Continued)

FOREIGN PATENT DOCUMENTS

| | | |
|---|---|---|
| DE | 197 53 866 A1 | 8/1998 |
| JP | 10-122153 | 5/1998 |
| WO | WO 2008/138604 | 11/2008 |

OTHER PUBLICATIONS

International Search Report and Written Opinion mailed Jul. 6, 2010.

*Primary Examiner* — Charles Freay
*Assistant Examiner* — Patrick Hamo
(74) *Attorney, Agent, or Firm* — Merchant & Gould P.C.

(57) ABSTRACT

A fluid device includes a variable swashplate adapted for movement between a first position and a second position. A control piston is adapted to selectively move the variable swashplate between the first and second positions. A control valve is in fluid communication with the control piston. The control valve includes a sleeve defining a spool bore, at least one fluid inlet passage in fluid communication with a fluid source and at least one control passage in fluid communication with the control piston. The control fluid passage includes an opening at the spool bore. A spool is disposed in the spool bore of the sleeve. The spool includes a metering surface that selectively communicates fluid between the fluid inlet passage and the control fluid passage. The metering surface has a first end and a second end. The metering surface having a tapered surface disposed between the first and second ends.

17 Claims, 9 Drawing Sheets

(56) References Cited

U.S. PATENT DOCUMENTS

| | | | | |
|---|---|---|---|---|
| 5,123,815 | A * | 6/1992 | Larkin et al. | 417/222.1 |
| 5,243,820 | A * | 9/1993 | Shimoura et al. | 60/452 |
| 5,447,176 | A * | 9/1995 | Asou et al. | 137/625.66 |
| 5,567,123 | A | 10/1996 | Childress et al. | |
| 5,740,718 | A | 4/1998 | Rathweg | |
| 5,782,160 | A * | 7/1998 | Boone | 92/12.2 |
| 5,890,876 | A * | 4/1999 | Suito et al. | 417/213 |
| 6,095,760 | A * | 8/2000 | Houtman | 417/222.2 |
| 6,119,967 | A * | 9/2000 | Nakayama et al. | 241/34 |
| 6,126,418 | A | 10/2000 | Sinnl | |
| 6,126,718 | A | 10/2000 | Sawa et al. | |
| 6,374,722 | B1 | 4/2002 | Du et al. | |
| 6,413,055 | B1 | 7/2002 | Geringer et al. | |
| 6,631,880 | B2 * | 10/2003 | Kandel | 251/14 |
| 6,810,912 | B2 * | 11/2004 | Ogura et al. | 137/625.69 |
| 6,938,413 | B2 | 9/2005 | Hatnischfeger | |
| 7,086,225 | B2 * | 8/2006 | Kadlicko | 60/413 |
| 7,117,881 | B2 * | 10/2006 | Muller | 137/118.07 |
| 7,992,484 | B2 * | 8/2011 | Kadlicko | 92/12.2 |
| 2004/0000142 | A1 * | 1/2004 | Nunomura | 60/445 |
| 2007/0051414 | A1 * | 3/2007 | Nakai et al. | 137/625.69 |
| 2009/0101854 | A1 * | 4/2009 | Jeon | 251/63 |
| 2010/0028168 | A1 * | 2/2010 | Shimizu et al. | 417/213 |
| 2010/0148099 | A1 * | 6/2010 | Lundberg et al. | 251/63 |
| 2010/0258210 | A1 * | 10/2010 | Miyazoe et al. | 137/625.69 |
| 2011/0079006 | A1 * | 4/2011 | Du | 60/327 |

* cited by examiner

CONTROL VALVE FOR A VARIABLE DISPLACEMENT PUMP

BACKGROUND

A variable displacement axial piston pump/motor includes a swashplate against which axial pistons are slidably engaged. The swashplate is adapted to pivot about an axis in order to increase or decrease the displacement of the axial piston pump/motor.

Some axial piston pumps/motors include a controller that is adapted to adjust the displacement of the swashplate in response to a pump/motor over-limit condition (e.g., pressure, torque, etc.). These controllers typically provide flow to a swashplate piston that is adapted to adjust the position of the swashplate relative to the axis. However, accurate positioning of the swashplate in the axial piston pump/motor in response to the over-limit condition can be difficult to attain.

SUMMARY

An aspect of the present disclosure relates to a fluid device having a variable swashplate adapted for movement between a first position and a second position. A control piston is adapted to selectively move the variable swashplate between the first and second positions. A control valve is in fluid communication with the control piston. The control valve includes a sleeve defining a spool bore, at least one fluid inlet passage that is in fluid communication with a fluid source and at least one control passage that is in fluid communication with the control piston. The control fluid passage includes an opening at the spool bore. A spool is slidably disposed in the spool bore of the sleeve. The spool includes a metering surface that selectively communicates fluid between the fluid inlet passage and the control fluid passage. The metering surface having a first end and an oppositely disposed second end. The metering surface having a tapered surface disposed between the first and second ends.

Another aspect of the present disclosure relates to a control valve of a fluid device. The control valve includes a sleeve defining a spool bore and at least one control passage. The control fluid passage has an opening at the spool bore. The control valve further includes a spool slidably disposed in the spool bore of the sleeve. The spool includes a metering surface having a first end, an oppositely disposed second end and a tapered surface disposed between the first and second ends. The tapered surface cooperates with the opening to define a variable orifice. The tapered surface is adapted to provide a linear flow area per axial displacement of the spool in the spool bore over a range of axial displacements of the spool in the spool bore.

Another aspect of the present disclosure relates to a method to compensate a fluid device in response to an over-limit condition. The method includes providing the fluid device having a control valve in selective fluid communication with a control piston that is adapted to adjust a displacement of the fluid device. The control valve includes a spool having a metering surface and an opening to a control fluid passage that is in fluid communication with the control piston. The metering surface has a tapered surface. The method further includes displacing the spool in the control valve to define a flow area between the tapered surface and the opening, where fluid enters the control fluid passage through the flow area.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
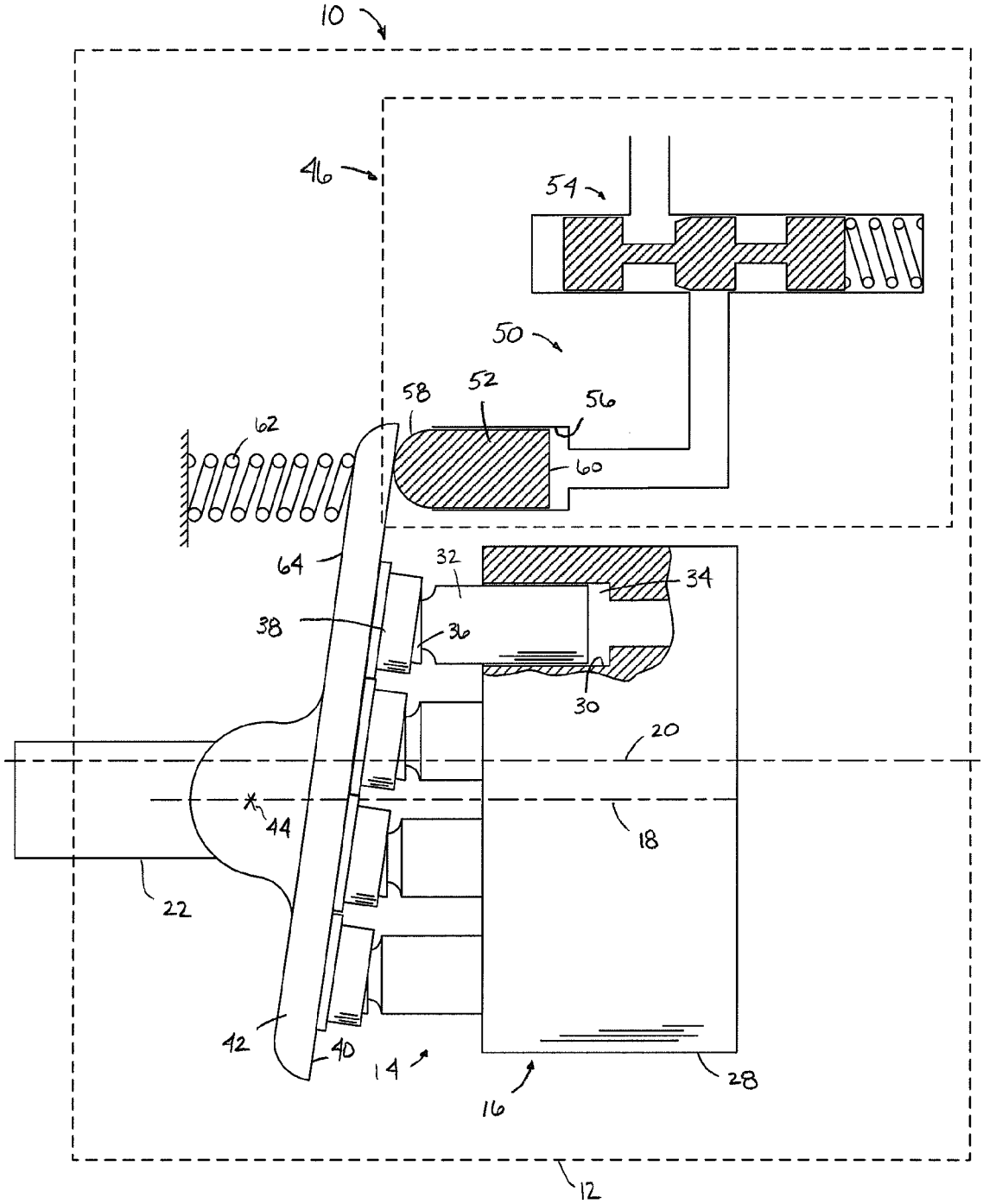
FIG. 1 is a schematic representation of a fluid device having exemplary features of aspects in accordance with the principles of the present disclosure.
Figure 2:
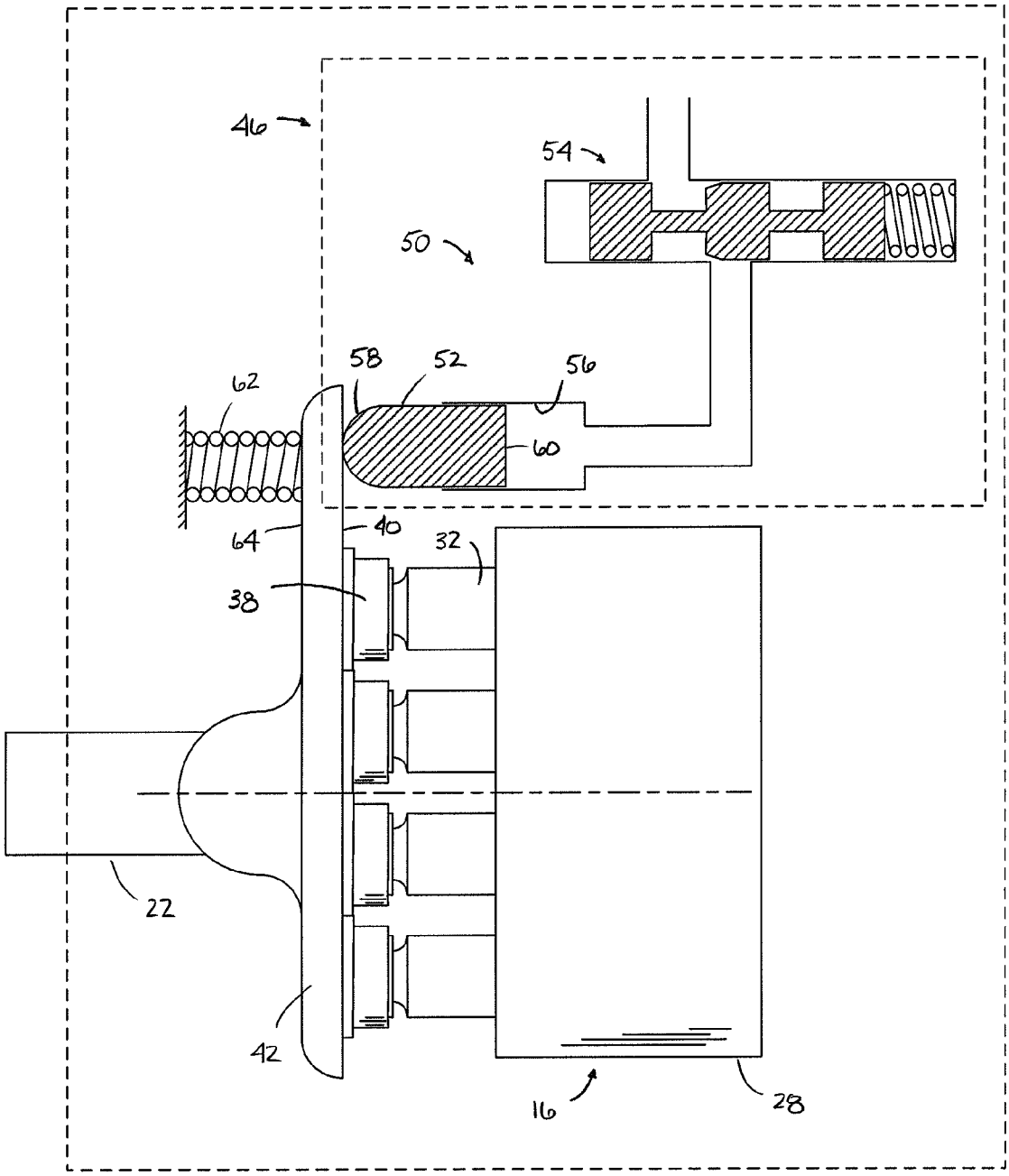
FIG. 2 is a schematic representation of the fluid device of FIG. 1 showing a swashplate in a second position.

Referring to FIGS. 1 and 2, a fluid device, generally designated 10, is shown. The fluid device 10 includes a housing, generally designated 12, defining a pumping chamber 14. A rotating group, generally designated 16, is disposed in the pumping chamber 14 of the housing 12. The rotating group 16 is adapted to rotate about a rotational axis 18. In the depicted example of FIG. 1, the rotational axis 18 is offset from the longitudinal axis 20 of the fluid device 10.

The rotating group 16 is engaged to an input shaft 22. In one aspect of the present disclosure, the rotating group 16 includes a plurality of internal splines that are engaged to a plurality of external splines disposed on the input shaft 22.

In one aspect of the present disclosure, the rotating group 16 includes a cylinder barrel, generally designated 28, defining a plurality of cylinder bores 30. A plurality of pistons 32 is adapted to reciprocate in the plurality of cylinder bores 30 when the cylinder barrel 28 is rotated about the rotating axis 18 and the fluid device 10 is at some displacement other than zero. The plurality of cylinder bores 30 and the plurality of pistons 32 cooperatively define a plurality of volume chambers 34. When the displacement of the fluid device 10 is as some displacement other than zero, at least one of the plurality of volume chambers 34 contracts while at least one of the plurality of volume chambers 34 expands. Fluid enters the expanding volume chambers 34 and is expelled from the contracting volume chambers 34 during rotation of the rotating group 16.

The plurality of pistons 32 includes axial ends 36 that are engaged with a plurality of slippers 38. The plurality of slippers 38 is disposed against a first surface 40 of a rotationally-stationary swashplate 42. As the rotating group 16 rotates about the rotational axis 18, the slippers 38 slide about the first surface 40 of the swashplate 42.

While the swashplate 42 is rotationally stationary with respect to the rotating axis 18, the position of the swashplate 42 is variable. In one aspect of the present disclosure, the swashplate 42 is adapted to tilt or pivot about a transverse axis 44 (shown as an X in FIG. 1) in order to increase or decrease the displacement of the fluid device 10. In one aspect of the present disclosure, the transverse axis 44 is generally perpendicular to the rotational axis 18 of the rotating group 16. As the displacement of the fluid device 10 increases, the amount of fluid that enters and is expelled from the rotating group 16 increases. As the displacement of the fluid device 10 decreases, the amount of fluid that enters and is expelled from the rotating group 16 decreases.

The swashplate 42 is movable between a first position (shown in FIG. 1) and a second position (shown in FIG. 2). In one aspect of the present disclosure, the first position is a full displacement or full stroke position. In another aspect of the present disclosure, the second position is a neutral position. In the neutral position, the first surface 40 of the swashplate 42 is generally perpendicular to the rotational axis 18 of the rotating group 16. In this position, the amount of fluid displaced by the rotating group 16 per revolution is about zero $in^3$/rev.

Referring now to FIGS. 1-4, the fluid device 10 further includes a control system 46. In one aspect of the present disclosure, the control system 46 is adapted to adjust the displacement of the fluid device 10 based on the output torque of the fluid device 10. If the output torque of the fluid device 10 exceeds a limit, the control system 46 reduces the displacement of the fluid device 10 (or destrokes the fluid device 10) to bring the output torque of the fluid device 10 within an acceptable range.

In one aspect of the present disclosure, the control system 46 includes a controller assembly 50 that is adapted to adjust the position of the swashplate 42 between the first and second positions. The controller assembly 50 includes a control piston 52 and a control valve 54 that is in fluid communication with the control piston 52.

The control piston 52 is slidably disposed in a piston bore 56 of the housing 12. The control piston 52 includes a first axial end portion 58 and a second axial end portion 60. The control piston 52 is disposed in the piston bore 56 such that the first axial end portion 58 of the control piston 52 is adjacent to the first surface 40 of the swashplate 42. In one aspect of the present disclosure, the first axial end portion 58 of the control piston 52 is immediately adjacent to the first surface 40 of the swashplate 42. In one aspect of the present disclosure, the control piston 52 is adapted to extend from the piston bore 56 in response to fluid communicated to the second axial end portion 60 of the control piston 52 through the control valve 54. As the control piston 52 extends from the piston bore 56, the first axial end portion 58 acts against the first surface 40 of the swashplate 42 and causes the swashplate 42 to pivot toward the second position.

In another aspect of the present disclosure, a spring 62 is disposed in the housing 12 such that the spring 62 is adjacent to a second surface 64 of the swashplate 42, which is oppositely disposed from the first surface 40. The spring 62 biases the control piston 52 to the retracted position when fluid is not being communicated to control piston 52 and biases the swashplate 42 to the first position.

Figure 3:
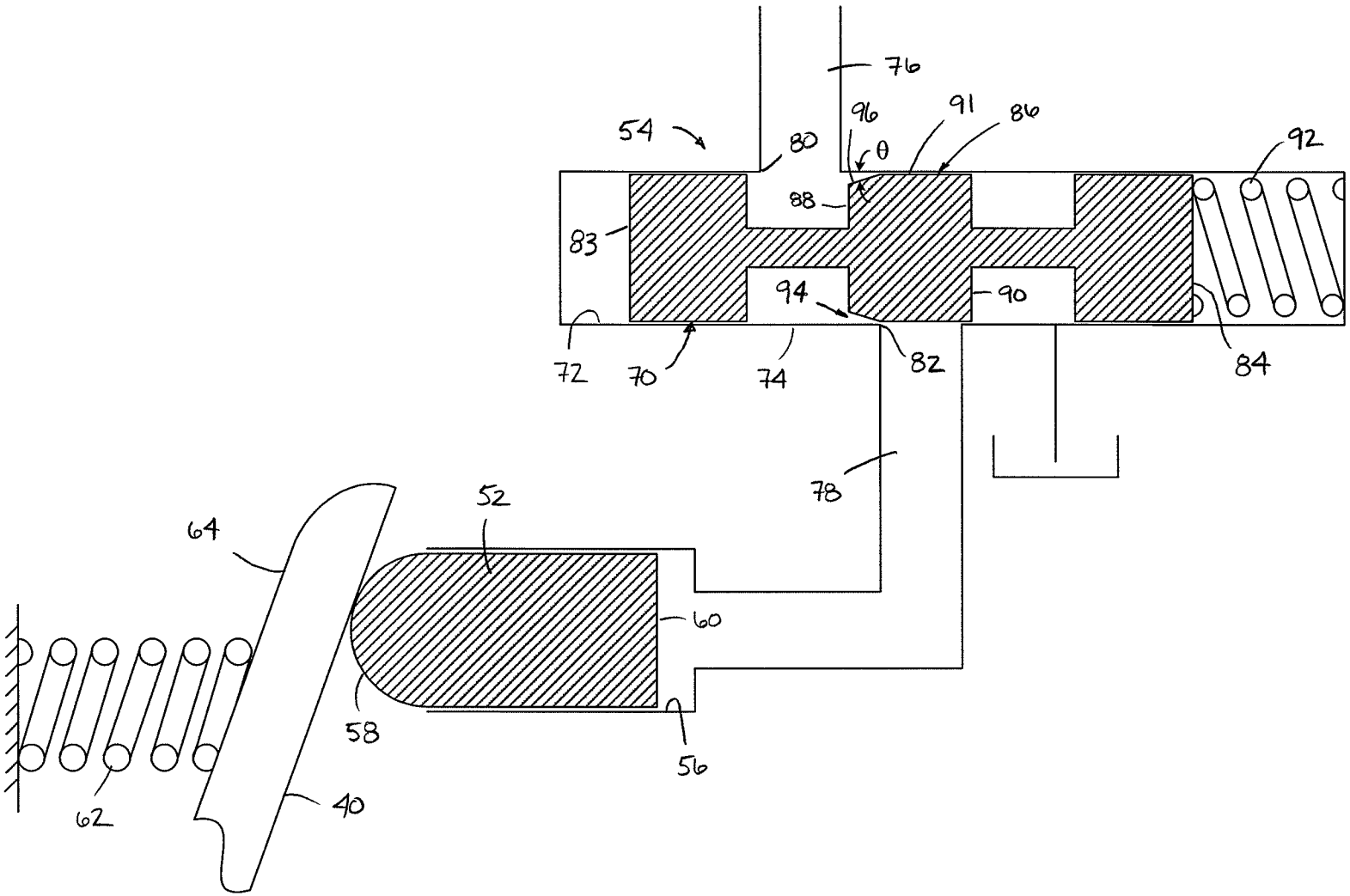
FIG. 3 is an enlarged schematic representation of a control system of the fluid device of FIG. 1.
Figure 4:
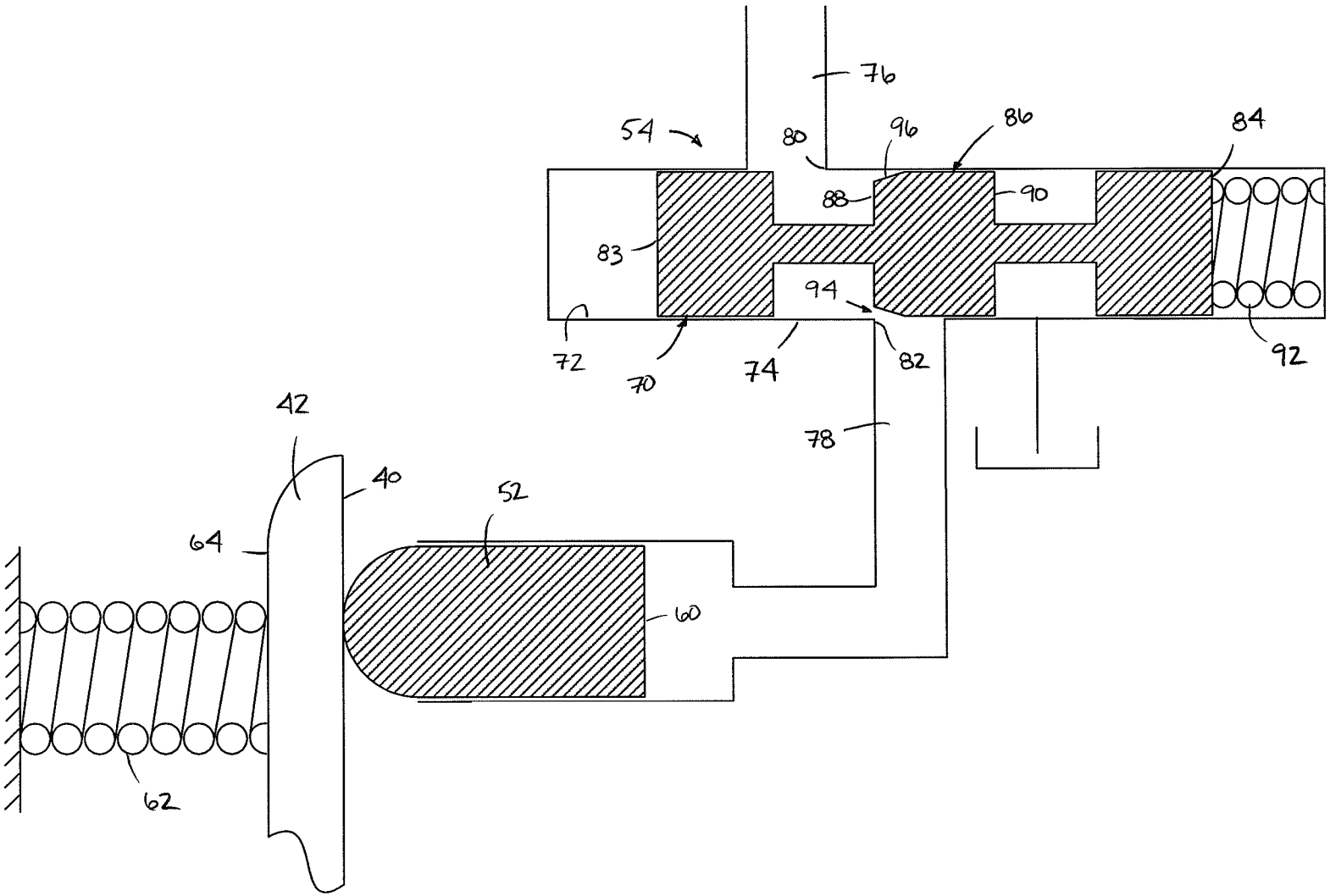
FIG. 4 is an enlarged schematic representation of the control system of FIG. 2.
Figure 5:
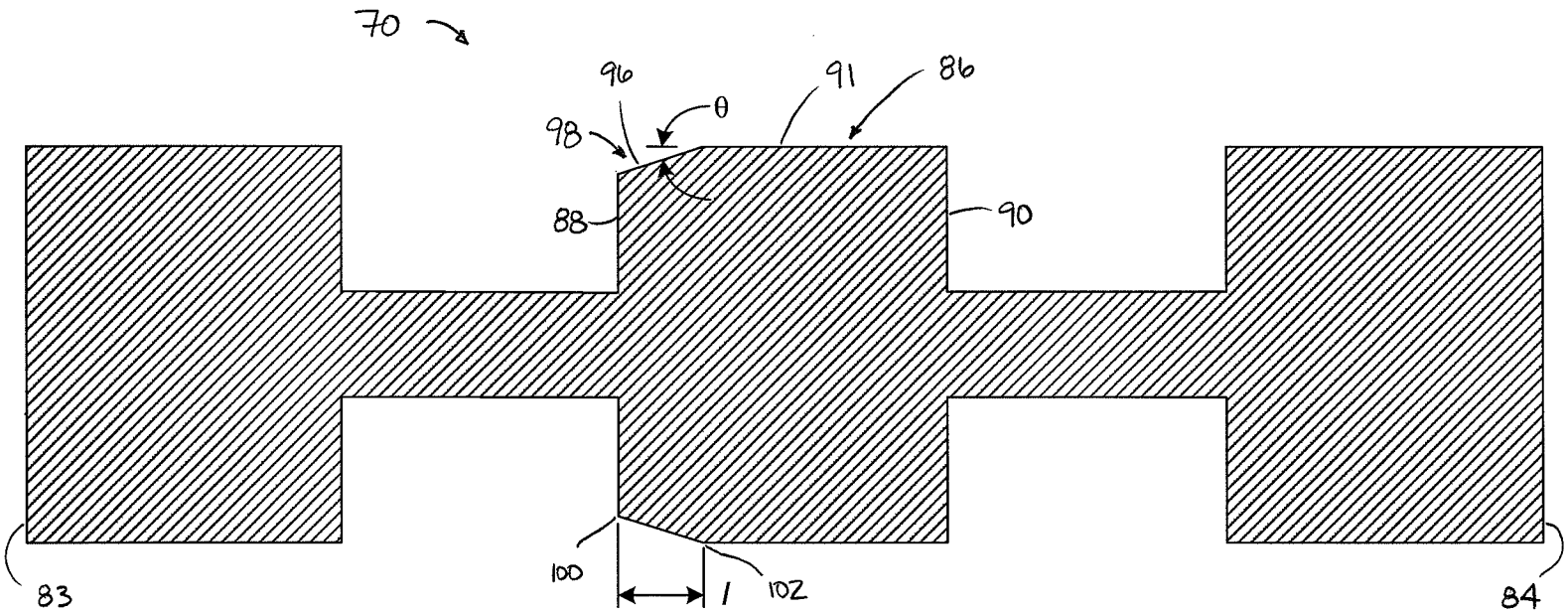
FIG. 5 is a schematic representation of a spool suitable for use in the control system of FIG. 3.

Referring now to FIGS. 3-5, the control valve 54 includes a spool 70 that is slidably disposed in a spool bore 72. In one aspect of the present disclosure, the spool bore 72 is defined by a sleeve 74 of the control valve 54. In one aspect of the present disclosure, the control valve 54 defines at least one fluid inlet passage 76 that is in fluid communication with a fluid source (e.g., a fluid discharge port of the fluid device 10, etc.) and at least one control fluid passage 78 that is in fluid communication with the piston bore 56. The fluid inlet passage 76 includes an inlet opening 80 at the spool bore 72 while the control fluid passage 78 includes an opening 82 at the spool bore 72. In one aspect of the present disclosure, there are at least two control fluid passages 78 with each control fluid passage 78 having the opening 82. In another aspect of the present disclosure, there are at least four control fluid passages 78. In another aspect of the present disclosure, the opening 82 at the spool bore 72 is generally circular in shape.

The spool 70 includes a first axial end 83 and an oppositely disposed second axial end 84. The spool 70 further includes a metering surface 86 that is disposed between the first and second axial ends 83, 84. The metering surface 86 is adapted to selectively block fluid communication between the fluid inlet passage 76 and the control fluid passage 78. It will be understood, however, that the term "block" as used herein allows for leakage across the metering surface 86 of the spool 70 as a result of clearances between the spool 70 and the spool bore 72.

The metering surface 86 extends between a first end 88 and a second end 90. The metering surface 86 includes an outer surface 91 that is generally cylindrical in shape.

In one aspect of the present disclosure, the spool 70 is biased by a spring 92 to a first position in which the fluid inlet passage 76 is blocked from fluid communication with the control fluid passage 78 by the metering surface 86. In the depicted schematic of FIGS. 3 and 4, the spring 92 acts against the second axial end 84 of the spool 70.

The pressure of the fluid from the fluid source (e.g., the discharge port of the fluid device 10) acts on the spool 70 in the spool bore 72 in a direction opposite from the direction of the force applied to the spool 70 from the spring 92. When the pressure of the fluid from the fluid source increases such that the force applied to the spool 70 by the fluid is greater than the force applied to the spool 70 by the spring 92, the spool 70 is axially displaced from the first position in the spool bore 72. As the spool 70 is axially displaced from the first position in the spool bore 72, the metering surface 86 at least partially uncovers the opening 82 of the control fluid passage 78. As the metering surface 86 uncovers the opening 82, the spool 70 allows for fluid communication between the fluid inlet passage 76 and the control fluid passage 78. As the pressure of the fluid source increases, the spool 70 is further displaced in the spool bore 72 so that the metering surface 86 uncovers more of the opening 82. In one aspect of the present disclosure, the spool 70 is displaced to a second position in which the opening 82 is fully uncovered.

The metering surface 86 of the spool 70 and the opening 82 of the control fluid passage 78 cooperatively define a variable orifice 94. The variable orifice 94 defines a variable flow area through which fluid can pass into the control fluid passage 78. With the spool 70 in the first position, the flow area of the variable orifice 94 is zero. As the spool 70 is axially displaced in the spool bore 72 away from the first position, the flow area of the variable orifice 94 increases. The size of the flow area of the variable orifice 94 affects the volumetric flow rate Q of fluid passing through the control fluid passage 78 to the control piston 52.

The volumetric flow rate Q is characterized by the following equation:

$$Q = C_d * A * \sqrt{\frac{2}{\rho}\Delta P},$$

where Q is the volumetric flow rate of fluid passing through the variable orifice 94 to the control piston 52, $C_d$ is a discharge coefficient, ρ is the density of the fluid, ΔP is the pressure differential across the flow area, A is the flow area of the variable orifice 94 through which the fluid passes. The stability of the control system 46 is directly dependent on the volumetric flow rate of the fluid from the control valve 54 to the control piston 52.

In the present disclosure, the term "stability" refers to a generally oscillation-free response of the swashplate 42, which is adapted to provide a predictable response of the control system 46 to over-limit conditions (e.g., exceeding torque limit, pressure limit, etc.) of the fluid device 10. For example, if pressurized fluid from the inlet fluid passage 76 overcomes the force of the spring 92 acting on the spool 70 thereby opening the control fluid passage 78 and if the flow area of the variable orifice 94 is too large, the volumetric flow rate Q of the fluid passing through the flow area of the variable orifice 94 will be too high. As a result, the control piston 52 will respond too quickly to the fluid passing through the control fluid passage 78, which may cause the control piston 52 to overcompensate for the fluid provided through the control fluid passage 78 and thereby over adjust the swashplate 42. Following this over-adjustment, the extra fluid in the piston bore 56 will be drained in an attempt to position the swashplate 42 to the desired position. If, on the other hand, the flow area of the variable orifice 94 is too small, the volumetric flow rate Q of the fluid passing through the flow area of the variable orifice 94 will be too low. As a result, the control piston 52 will respond too slowly to the over-limit condition.

In addition to the size of the flow area of the variable orifice 94, the stability of the fluid device 10 is also affected by the temperature of the fluid. As the temperature of the fluid increases, the viscosity of the fluid decreases. As the viscosity of the fluid decreases, the volume of fluid that can flow through the flow area of the variable orifice 94 during a given time interval (Δt) increases. As the volume of fluid flowing through the flow area of the variable orifice 94 increases, the response rate of the control piston 52 increases. In some situations, this increased response rate may result in the fluid device 10 becoming unstable.

In one aspect of the present disclosure, the control system 46 is stabilized by providing a tapered surface 96 at a leading edge portion 98 of the metering surface 86 of the spool 70. In one aspect of the present disclosure, the tapered surface 96 of the metering surface 86 of the spool 70 reduces the risk of instability of the control system 46 when fluid (e.g., hydraulic fluid, oil, etc.) at high temperatures (e.g., >140 degrees F.) is used in the fluid device 10.

The tapered surface 96 of the metering surface 86 of the spool 70 is adapted to cooperate with the opening 82 of the control fluid passage 78 to define a flow area that reduces flow to the control piston 52 at small axial displacements of the spool 70 as compared to a flow area defined by the opening 82 and a metering surface of a spool without a tapered surface 96. The tapered surface 96 and the opening 82 cooperate to define a generally linear gain (shown in FIG. 10) of the control system 46 for small axial displacements of the spool 70, where the gain of the control system 46 is defined by the flow area divided by the axial displacement of the spool 70. In one aspect of the present disclosure, the tapered surface 96 and the opening 82 cooperate to define a generally constant gain of the control system 46 for small axial displacements of the spool 70.

The tapered surface 96 extends a length l from a first edge 100 to a second edge 102, which is disposed between the first end 88 and the second end 90 of the metering surface 86. In the depicted examples of FIGS. 1-5, the first edge 100 is disposed on the first end 88 of the metering surface 86. In one aspect of the present disclosure, the length l is greater than 0.010 inches. In another aspect of the present disclosure, the length l is greater than or equal to 2% of the outer diameter of the metering surface 86. In another aspect of the present disclosure, the length l is in the range of about 2% to about 5% of the outer diameter of the metering surface 86.

The tapered surface 96 includes an angle θ. The angle θ of the tapered surface 92 flares outwardly in a direction from the first edge 100 to the second edge 102 so that the outer diameter of the tapered surface 96 at the first edge 100 is less than the outer diameter of the tapered surface 96 at the second edge 102.

The angle θ is an oblique angle. In one aspect of the present disclosure, the angle θ can be calculated using the following equation 104:

$$\theta \leq \sin^{-1} \frac{n * \cos^{-1}\left(\frac{r-l}{r}\right) * r^2}{\pi * D * l},$$

where θ is the angle of the taper surface 96, n is the number of openings 82 in the spool bore 72, r is the radius of each of the openings 82, D is the diameter of the metering surface 86 of the spool 70, and l is the axial length of the tapered surface 96. In one aspect of the present disclosure, the angle θ is less than 30 degrees.

Figure 6:
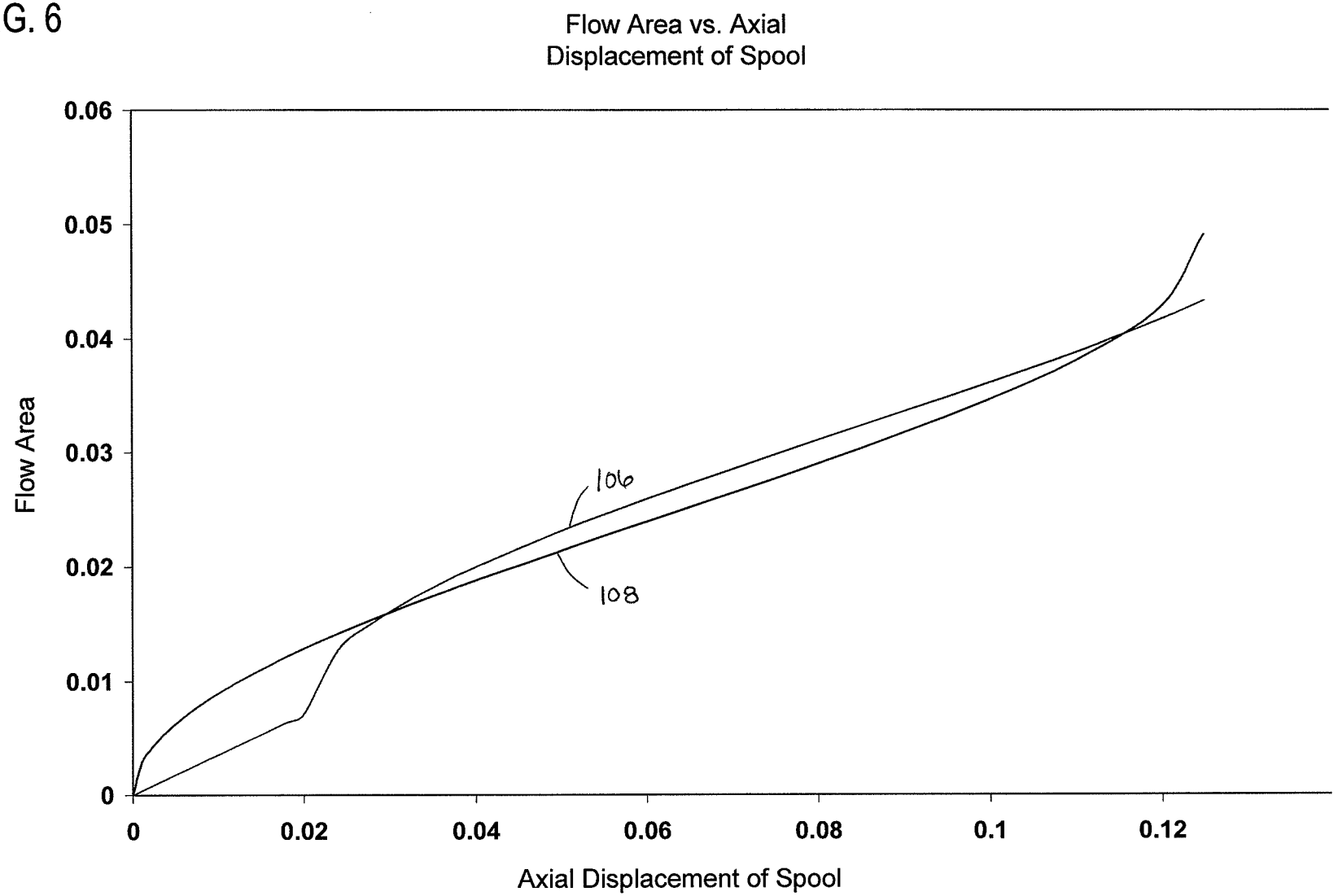
FIG. 6 is an exemplary graphical representation of flow area of the control valve of FIG. 3 versus the axial displacement of a spool of the control valve.
Figure 7:
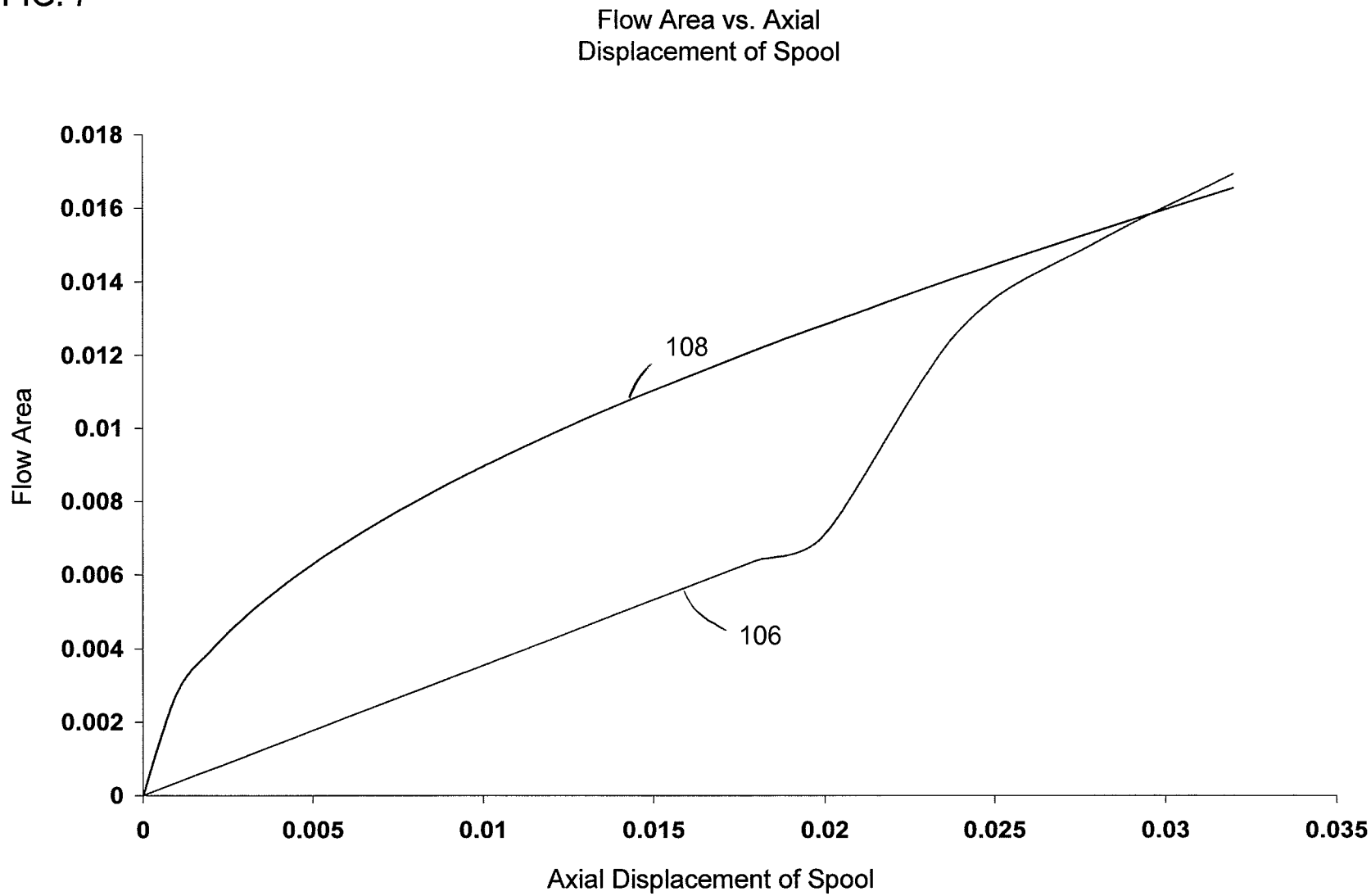
FIG. 7 is an enlarged view of the graph of FIG. 6.

Referring now to FIGS. 6 and 7, a graph of the flow area of the variable orifice 94 versus the axial position of the spool 70 in the spool bore 72 is shown. The graph includes two curves. A first curve 106 plots the flow area of the variable orifice 94 versus the axial position of the spool 70, where the spool 70 includes the tapered surface 96. A second curve 108 plots the flow area of the variable orifice 94 versus the axial position of the spool 70, where the spool 70 does not include the tapered surface 96.

As shown in the graph, the spool 70 with the tapered surface 96 reduces the flow area of the variable orifice 94 during an initial axial displacement (i.e., measured from the edge of the opening 82 to the second edge 102 of the tapered surface 96) of the spool 70 as compared to the spool 70 without the tapered surface 96. This reduction in flow area of the variable orifice 94 reduces the risk of a high volumetric flow rate Q being provided to the control piston 52 as a result of a small displacement of the spool 70.

During the initial displacement of the spool 70 with the tapered surface 96, the flow area of the variable orifice 94 is equal to the area defined between the edge of the opening 82 and the tapered surface 96 of the spool 70 provided that the angle θ is less than or equal to the angle calculated using equation 104. As this area is less than the area of the opening 82 uncovered by the spool 70, the risk of a high volumetric flow rate of fluid being communicated to the control piston 52 is reduced. If the angle θ is greater than the angle calculated using equation 104, the flow area of the variable orifice 94 will be generally equal to the area of the opening 82 that is uncovered by the spool 70 and will be generally equal to the spool 70 without the tapered surface 96.

After the spool 70 has been displaced a distance greater than the axial length l of the tapered surface 96, the flow area of the variable orifice 94 is generally equal to the area of the opening 82 that is uncovered by the spool 70. During this displacement region, the tapered surface 96 has limited affect on the flow area of the variable orifice 94.

In one aspect of the present disclosure, the axial length l of the tapered surface 96 is less than or equal to the diameter of the opening 82 of the control fluid passage 78. In another aspect of the present disclosure, the axial length l of the tapered surface 96 of the spool 70 is less than or equal to 10% of the diameter of the opening 82. In another aspect of the present disclosure, the axial length l of the tapered surface 96 of the spool 70 is less than or equal to 5% of the diameter of the opening 82. In another aspect of the present disclosure, the axial length l of the tapered surface 96 of the spool 70 is less than or equal to 0.030 inches. In another aspect of the present disclosure, the axial length l of the tapered surface 96 of the spool 70 is less than or equal to 0.020 inches.

Figure 8:
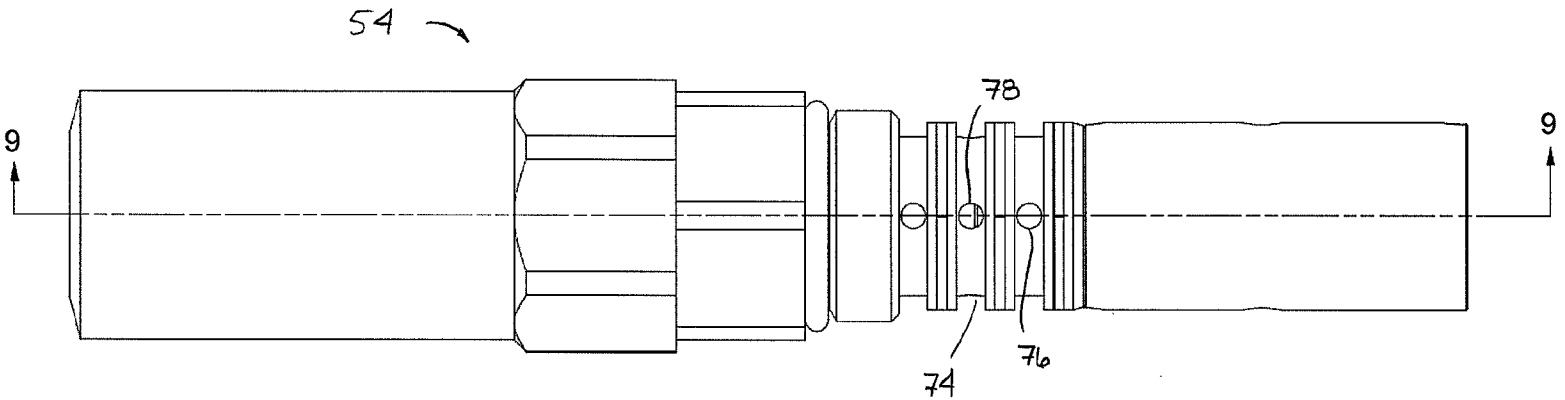
FIG. 8 is an exemplary embodiment of the control valve shown schematically in FIG. 3.
Figure 9:
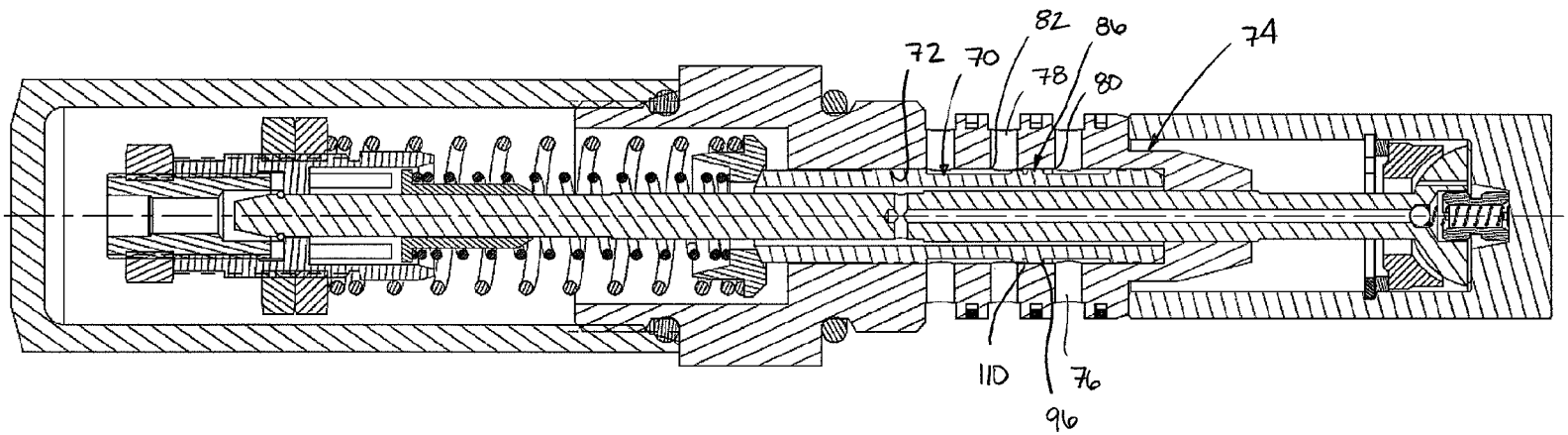
FIG. 9 is a cross-sectional view of the control valve taken on line 9-9 of FIG. 8.

Referring now to FIGS. 8 and 9, an exemplary control valve 54 is shown. The control valve 54 includes the spool 70 disposed in the spool bore 72 of the sleeve 74. The sleeve 74 defines the fluid inlet passage 76 and the control fluid passage 78 that is in fluid communication with the piston bore 56. The fluid inlet passage 76 includes the inlet opening 80 at the spool bore 72 while the control fluid passage 78 includes the opening 82 at the spool bore 72.

The spool 70 includes the metering surface 86. The metering surface 86 includes the tapered surface 96. In the depicted example of FIGS. 8 and 9, the metering surface 86 further includes a groove 110 that extends circumferentially around the metering surface 86. The groove 110 is disposed between the tapered surface 96 and the second end 90 of the metering surface 86. The groove 110 is adapted for pressuring balancing the spool 70 in a radial direction in the spool bore 72.

Figure 10:
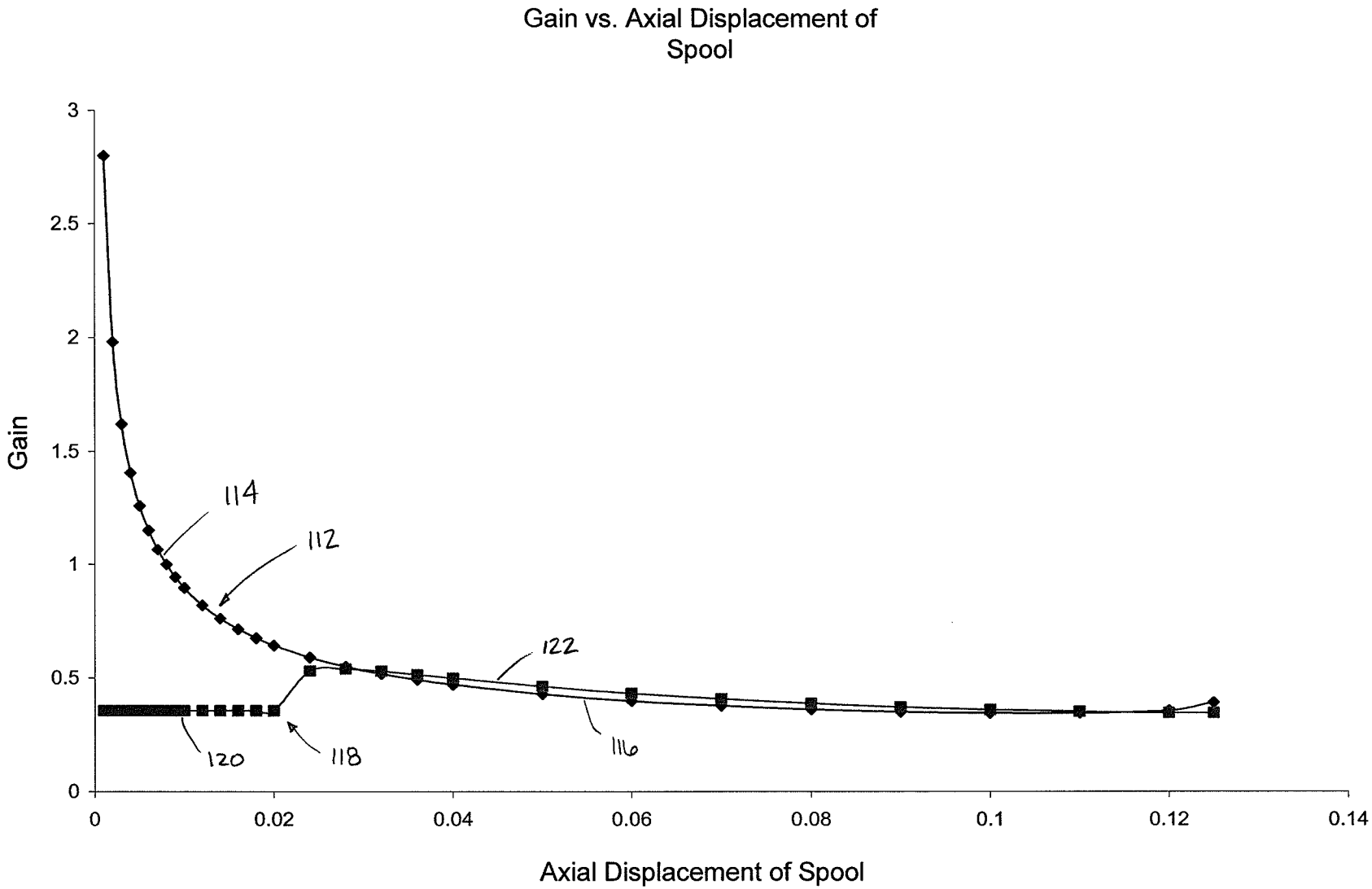
FIG. 10 is an exemplary graphical representation of gain of the control valve of FIG. 3 versus the axial displacement of the spool.

Referring now to FIG. 10, a method for determining the dimensions of the parameters of the tapered surface 96 will be described. The values of the parameters, such as the number of metering holes n, the radius of the metering holes r and the diameter D of the spool 70 are determined. In one aspect of the present disclosure, these values are determined using a root-locus approach. In another aspect of the present disclosure, these values are determined using a loop-shaping approach.

A gain 112 versus axial displacement of the spool 70 is graphed. As previously provided, gain 112 is the measure of flow area of the variable orifice 94 versus the axial displacement of the spool 70. The flow area is calculated for a spool 70 without a tapered surface 96. The gain 112 for the spool 70 without the tapered surface 96 is shown in FIG. 10. The gain 112 includes a first portion 114 and a second portion 116. The first portion 114 is nonlinear. The second portion 116 is nonlinear although the best curve fit through the second portion is a straight line. The length l of the tapered surface 96 is determined at the location where the first and second portions intersect. In the example shown in FIG. 10, this location is at a spool position of 0.020 inches.

The angle θ for the tapered surface 96 is calculated using the equation 104. The angle θ of the tapered surface 96 is then cut into the spool 70 such that the angle θ is less than or equal to the value provided by the equation 104. With the angle θ of the tapered surface 96 less than or equal to the value provided by the equation 104, the metered surface 86 has a gain 118 (shown in FIG. 10). The gain 118 includes a first portion 120 and a second portion 122. The first portion 120 is generally linear over a range of axial displacements of the spool 70. In one aspect of the present disclosure, the range of axial displacements of the spool 70 over which the first portion 120 is generally linear is equal to the axial length l of the tapered surface 96. In one aspect of the present disclosure, the gain 120 is generally constant over a range of axial displacements of the spool 70. This generally constant gain 120 provides a linear increase in volumetric flow rate Q as the spool 70 is displaced in the spool bore 72. In one aspect of the present disclosure, the range of axial displacements of the spool 70 over which the first portion 120 is generally constant is equal to the axial length l of the tapered surface 96.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A fluid device comprising:

a variable swashplate adapted for movement between a first position and a second position;

a control piston adapted to selectively move the variable swashplate between the first and second positions;

a control valve in fluid communication with the control piston, the control valve including:

a sleeve defining a spool bore, at least one fluid inlet passage that is in fluid communication with a fluid source and at least one control fluid passage that is in fluid communication with the control piston, the control fluid passage having an opening at the spool bore, the opening having a first diameter; and a spool slidably disposed in the spool bore of the sleeve, the spool including a metering surface that selectively communicates fluid between the fluid inlet passage and the control fluid passage, the metering surface having a first end and an oppositely disposed second end, the metering surface having a generally cylindrical outer surface and a continuously tapered surface disposed between the first and second ends, the tapered surface meeting the generally cylindrical outer surface at a common edge, the tapered surface including an oblique angle that flares outwardly from the first end to the second end, wherein the degree of the angle is a function of at least one dimension of the opening, wherein the tapered surface has an axial length of not more than about 10 percent of the first diameter and the degree of the angle of the tapered surface is adapted to provide a linear flow area per axial displacement of the spool over a range of axial displacements equaling the axial length of the tapered surface.

2. The fluid device of claim 1, wherein the angle is less than or equal to $$\sin^{-1}\frac{n*\cos^{-1}\left(\frac{r-l}{r}\right)*r^2}{\pi*D*l},$$

where r is the radius of the opening, n is the number of control fluid passages disposed in the sleeve, D is a diameter of the spool, and l is an axial length of the tapered surface on the metering surface.

3. The fluid device of claim 1, wherein the angle of the tapered surface is less than 30 degrees.

4. The fluid device of claim 1, wherein the angle of the tapered surface is adapted to provide a linear gain over a range of axial displacements of the spool.

5. The fluid device of claim 4, wherein the angle of the tapered surface is adapted to provide a constant gain over the range of axial displacements of the spool.

6. The fluid device of claim 1, wherein the opening is generally circular.

7. The fluid device of claim 1, wherein the metering surface defines a groove that is adapted to pressure balance the spool in the spool bore in a radial direction.

8. A control valve of a fluid device comprising:

a sleeve defining a spool bore and at least one control fluid passage, the control fluid passage having an opening at the spool bore, the opening having a first diameter; and a spool slidably disposed in the spool bore of the sleeve, the spool including a metering surface having a first end, an oppositely disposed second end and a continuously tapered surface disposed between the first and second ends, the tapered surface cooperating with the opening to define a variable orifice, wherein the tapered surface is adapted to provide a linear flow area per axial displacement of the spool in the spool bore over a range of axial displacements of the spool in the spool bore, the tapered surface meeting a generally cylindrical outer surface at a common edge, the tapered surface including an oblique angle that flares outwardly from the tapered surface including an oblique angle that flares outwardly from the first end to the second end, wherein the degree of the angle is a function of at least one dimension of the opening, wherein the tapered surface has an axial length of not more than about 10 percent of a first diameter of the opening and the degree of the angle of the tapered surface is adapted to provide a linear flow area per axial displacement of the spool over a range of axial displacements equaling the axial length of the tapered surface.

9. The control valve of claim 8, wherein the tapered surface is adapted to provide a constant flow area per axial displacement of the spool in the spool bore over a range of axial displacements of the spool in the spool bore.

10. The control valve of claim 8, wherein the angle is less than or equal to $$\sin^{-1}\frac{n*\cos^{-1}\left(\frac{r-l}{r}\right)*r^2}{\pi*D*l},$$

where r is the radius of the opening, n is the number of control fluid passages disposed in the sleeve, D is a diameter of the spool, and l is an axial length of the tapered surface on the metering surface.

11. A method for compensating a fluid device in response to an over-limit condition, the method comprising:

providing the fluid device having a control valve in selective fluid communication with a control piston adapted to adjust a displacement of the fluid device, the control valve including a spool having a metering surface and an opening to a control fluid passage that is in fluid communication with the control piston, the metering surface having a continuously tapered surface, the tapered surface meeting a generally cylindrical outer surface at a common edge, the tapered surface including an oblique angle that flares outwardly from the first end to the second end, wherein the degree of the angle is a function of at least one dimension of the opening, wherein the tapered surface has an axial length of not more than about 10 percent of a first diameter of the opening and the degree of the angle of the tapered surface is adapted to provide a linear flow area per axial displacement of the spool over a range of axial displacements equaling the axial length of the tapered surface; and displacing the spool in the control valve to define a flow area between the tapered surface and the opening, wherein fluid enters the control fluid passage through the flow area.

12. The method of claim 11, wherein the angle is less than or equal to $$\sin^{-1}\frac{n*\cos^{-1}\left(\frac{r-l}{r}\right)*r^2}{\pi*D*l},$$

where r is the radius of the opening, n is the number of control fluid passages disposed in the control valve, D is a diameter of the spool, and l is an axial length of the tapered surface on the metering surface.

13. The method of claim 11, wherein the angle of the tapered surface is adapted to provide a flow area per axial displacement of the spool over a range of axial displacements of the spool that is linear.

14. The method of claim 11, wherein an upper limit of the range of axial displacement of the spool is less than or equal to a value that is 20% of the diameter of the spool.

15. The method of claim 11, wherein the angle of the tapered surface is adapted to provide a flow area per axial displacement of the spool over a range of axial displacements of the spool that is constant.

16. A fluid device comprising:

a variable swashplate adapted for movement between a first position and a second position;

a control piston adapted to selectively move the variable swashplate between the first and second positions;

a control valve in fluid communication with the control piston, the control valve including:

a sleeve defining a spool bore, at least one fluid inlet passage that is in fluid communication with a fluid source and at least one control fluid passage that is in fluid communication with the control piston, the control fluid passage having an opening at the spool bore, the opening having a first diameter; and a spool slidably disposed in the spool bore of the sleeve, the spool including a metering surface that selectively communicates fluid between the fluid inlet passage and the control fluid passage, the metering surface having a first end and an oppositely disposed second end, the metering surface having a continuously tapered surface and a generally cylindrical outer surface disposed between the first and second ends, the tapered surface including an oblique angle that flares outwardly in a direction from the first end toward the second end, the tapered surface meeting the generally cylindrical outer surface at a common edge, wherein the degree of the angle is a function of at least one dimension of the opening, wherein the tapered surface has an axial length of not more than about 10 percent of the first diameter and the degree of the angle of the tapered surface is adapted to provide a linear flow area per axial displacement of the spool over a range of axial displacements equaling the axial length of the tapered surface.

17. A fluid device comprising:

a variable swashplate adapted for movement between a first position and a second position;

a control piston adapted to selectively move the variable swashplate between the first and second positions;

a control valve in fluid communication with the control piston, the control valve including:

a sleeve defining a spool bore, at least one fluid inlet passage that is in fluid communication with a fluid source and at least one control fluid passage that is in fluid communication with the control piston, the control fluid passage having an opening at the spool bore, the opening having a first diameter; and a spool slidably disposed in the spool bore of the sleeve, the spool including a metering surface that selectively communicates fluid between the fluid inlet passage and the control fluid passage, the metering surface having a first end and an oppositely disposed second end, the metering surface having a continuously tapered surface disposed between the first and second ends, the tapered surface meeting a generally cylindrical outer surface at a common edge, the tapered surface including an oblique angle that flares outwardly from the first end to the second end, the degree of the oblique angle being at least one of less than 30 degrees and less than or equal to $$\sin^{-1}\frac{n*\cos^{-1}\left(\frac{r-1}{r}\right)*r^2}{\pi*D*l},$$

where r is the radius of the opening, n is the number of control fluid passages disposed in the sleeve, D is a diameter of the spool, and l is an axial length of the tapered surface on the metering surface, wherein the tapered surface has an axial length of not more than about 10 percent of the first diameter and the degree of the angle of the tapered surface is adapted to provide a linear flow area per axial displacement of the spool over a range of axial displacements equaling the axial length of the tapered surface.

* * * * *